US007622901B2

(12) United States Patent
Noda

(10) Patent No.: US 7,622,901 B2
(45) Date of Patent: Nov. 24, 2009

(54) SYSTEM POWER SUPPLY APPARATUS AND OPERATIONAL CONTROL METHOD

(75) Inventor: Ippei Noda, Osaka-fu (JP)

(73) Assignee: Ricoh Company, Ltd., Tokyo (JP)

( * ) Notice: Subject to any disclaimer, the term of this patent is extended or adjusted under 35 U.S.C. 154(b) by 119 days.

(21) Appl. No.: 11/477,323

(22) Filed: Jun. 30, 2006

(65) Prior Publication Data

US 2007/0001513 A1 Jan. 4, 2007

(30) Foreign Application Priority Data

Jun. 30, 2005 (JP) ..... 2005-192058

(51) Int. Cl.
*G05F 1/577* (2006.01)
*G05F 1/00* (2006.01)

(52) U.S. Cl. ..... 323/267; 323/269; 323/272; 307/82; 307/130

(58) Field of Classification Search ..... 323/267, 323/269, 273; 307/30, 35, 38, 39, 82, 130
See application file for complete search history.

(56) References Cited

U.S. PATENT DOCUMENTS 3,858,104 A * 12/1974 Grob ..... 363/23
5,210,504 A * 5/1993 Yagita et al. ..... 330/253
5,969,512 A * 10/1999 Matsuyama ..... 323/272
5,977,755 A * 11/1999 Miki et al. ..... 323/269
6,411,072 B1 * 6/2002 Feldman ..... 323/299
2004/0105198 A1 * 6/2004 Fujii ..... 361/18

FOREIGN PATENT DOCUMENTS

JP 2001-142548 A 5/2001
JP 3673458 B2 4/2005

* cited by examiner

*Primary Examiner*—Edward Tso
*Assistant Examiner*—M'Baye Diao
(74) *Attorney, Agent, or Firm*—Dickstein Shapiro LLP

(57) ABSTRACT

A system power supply apparatus includes a first constant voltage circuit that generates and increases a voltage up to a first constant level when receiving a first control signal. A second constant voltage circuit is provided to generate and increase a voltage up to a second constant level upon receiving a second control signal. The second constant voltage circuit generates and maintains a voltage at a third constant level lower than the second constant level for a prescribed time period upon receiving a third control signal. A control circuit is provided to input the third control signal to the second constant voltage circuit when the system power supply apparatus starts up.

16 Claims, 5 Drawing Sheets

SYSTEM POWER SUPPLY APPARATUS AND OPERATIONAL CONTROL METHOD

CROSS REFERENCE TO RELATED APLICATION

This application claims priority under 35 USC § 119 to Japanese Patent Application No. 2005-192058 filed on Jun. 30, 2005, the entire contents of which are herein incorporated by reference.

BACKGROUND OF THE INVENTION

1. Field of the Invention

The present invention relates to a system power supply apparatus that includes a plurality of circuits for providing constant voltages, and in particular, to a system power supply apparatus capable of controlling output voltages outputted from the plurality of constant voltage circuits when the system power supply apparatus starts up.

2. Discussion of the Background Art

Recently, as an electronic instrument increases a number of functions, a specification of a power supply becomes complex. For example, a plurality of voltages are generally demanded in one instrument, and accordingly, a relation between rising voltages is ruled. Then, a conventional microcomputer use power supply includes an A/D converter and necessitates a high precision power supply voltage to generate a reference power supply voltage Vref of the A/D converter beside a main power supply voltage Vdd as discussed in Japanese Patent Application Laid Open No. 2001-142548.

Further, the reference power supply voltage Vref needs to be controlled not to exceed the main power supply voltage Vdd to avoid latch up of the microcomputer at least when the power supply is turned on and off.

The power supply circuit generates the main power supply voltage Vdd of the microcomputer, and includes a DC-DC converter. A circuit generating the reference power supply voltage Vref employs an analog regulator 101 as shown in FIG. 6. Since an output voltage of the DC-DC converter generally slowly rises than the analog regulator, the reference power supply Vref rises faster than the main power supply voltage Vdd when the power supply is turned on without any counter measures there against. Thus, the reference voltage Vref becomes larger than the main power supply voltage Vdd.

Then, in the past, a control circuit 102 is added as shown in FIG. 6. Specifically, a resistance Rc and a constant current source ia are serially connected between the reference voltage Vref, outputted from the analog regulator 101, and ground so as to compare a voltage Va, smaller than the reference power supply voltage Vref by a voltage decreased by the resistance Rc, with the main power supply voltage Vdd in the control circuit 102. An operational amplifier circuit AMPb controls a transistor Tc connected to a base of a transistor Tb so that the voltage Va is controlled to become the main power supply voltage Vdd. Thus, the reference voltage Vref rises to a voltage smaller than that of the main power supply voltage Vdd along with rise of the main power supply voltage Vdd when the power supply is turned on.

However, when a difference in voltage between the Vdd and the Vref during their rising is ruled in addition to an order of reaching respective target voltages after a power supply is turned on, a circuit of FIG. 6 sometimes can't follow such a rule. For example, it is true when first and second power supply voltages rise quickly and slowly, respectively, and the first power supply voltage should reach the target voltage earlier that the second's, and a difference between the first and second voltages should be controlled not to exceed a prescribed value. Specifically, if the second power supply voltage rises too slowly, the difference exceeds the value, thereby dissatisfying a prescribed specification.

When the same type circuits, such as analog regulators, etc., constitute these power supply circuits, it is unknown that which of the respective output voltages outputted from these power supply circuits rises at a faster speed. Further, a rise time of an output voltage outputted from a power supply circuit largely depends on a load or a capacity of a bypath condenser connected to an output terminal of the power supply circuit. As a result, an order of a rise time of the output voltages outputted from these power supply circuits sometimes varies depending on a condition of the load or capacity.

FIGS. 7 to 9 illustrate various rising examples of output voltages VoA and VoB in the first and second constant voltage circuits, wherein VoA represents an output voltage of the first constant voltage circuit, whereas VoB, the second constant voltage circuit, respectively. Delta V represents a voltage difference between the respective output voltages VoA and VoB (i.e., VoA −VoB) VA and VB are target voltages of the output voltages VoA and VoB, respectively. Further, tA and tB are times when the output voltages VoA and VoB reach the target voltages VA and VB, respectively.

Now, it is herein below supposed that the below described first and second inequalities are given as rising conditions of the output voltages VoA and VoB, wherein Vc is a prescribed constant less than the target voltage VA;

$$tA<tB$$

(Hereinafter referred to as a first condition)

$$\Delta(\text{delta})<Vc$$

(Hereinafter referred to as a second condition)

FIG. 7 illustrates an example when these voltages VoA and VoB rise substantially the same speed. To meet the first condition, a sleep state of the first constant voltage circuit is released at the point A, and that of the second constant voltage circuit is released at the point B with a slight delay. As a result, the output voltages VoA and VoB rise substantially in parallel, and a voltage difference delta V is smaller than Vc as indicated by a two dotted line arrow. Thus, the below described condition is satisfied:

$$tA<tB$$

However, when the output voltage VoB of the second constant voltage circuit rises with a delay even though the sleep statuses of the first and second constant voltage circuits are released at substantially the same time as shown in FIG. 8, Δ (delta) V exceeds Vc during the rising of those, and thereby dissatisfying the second condition.

Further, as shown in FIG. 9, one of when the output voltage VoB rises earlier, the output voltage VoA rises later, and the output voltage VoB rises earlier while the output voltage VoA rises later, the above-mentioned first condition can't be met even if the second condition can be met.

SUMMARY

The present invention has been made in view of the above noted and another problems and one object of the present invention is to provide a new and noble system power supply apparatus that includes a first constant voltage circuit for generating and increasing a voltage up to a first constant level when receiving a first control signal. A first load is connected to the first constant voltage circuit. A second constant voltage circuit is provided to generate and increase a voltage up to a second constant level upon receiving a second control signal. The second constant voltage circuit generates and maintains a voltage at a third constant level lower than the second constant level for a prescribed time period upon receiving a third control signal. A second load is connected to the second constant voltage circuit. A control circuit is provided to input the third control signal to the second constant voltage circuit when the system power supply apparatus starts up.

In another embodiment, the control circuit controls the first and second constant voltage circuits to simultaneously operate when the system power supply apparatus starts up. The control circuit controls the second constant voltage circuit to generate and maintain the voltage at the third constant level until the voltage generated by the first constant voltage circuit reaches the first constant level. The control circuit also controls the second constant voltage circuit to generate and increase the voltage up to the second constant level when the output voltage of the first constant voltage circuit reaches the first constant level.

In yet another embodiment, the control circuit controls the second constant voltage circuit to operate earlier than the first constant voltage circuit. The control circuit also controls the second constant level circuit to generate and maintain the voltage at the third constant level until the output voltage of the first constant voltage circuit reaches the first constant level. The control circuit also controls the second constant voltage circuit to generate and increase the voltage up to the second constant level when the output voltage of the first constant voltage circuit reaches the first constant level.

In yet another embodiment, the control circuit controls the second constant voltage circuit to generate and increase the voltage up to the second constant level when a prescribed time needed for the output voltage of the first constant voltage circuit reaches the first constant level has elapsed.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
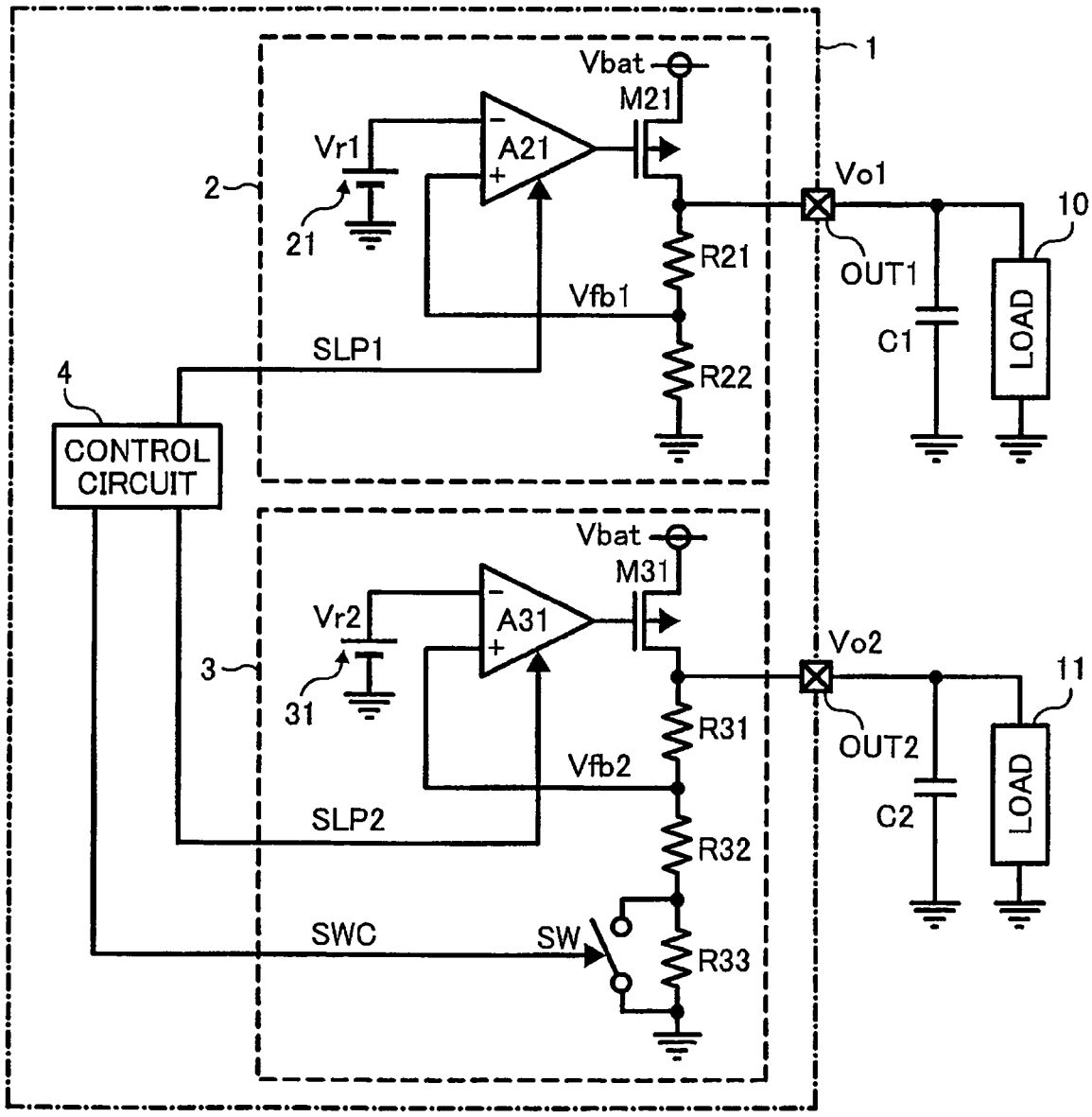
FIG. 1 illustrates an exemplary system power supply apparatus of the first embodiment according to the present invention.

Referring now to the drawings, wherein like reference numerals and marks designate identical or corresponding parts throughout several figures, in particular, in FIG. 1, an exemplary system power supply apparatus of the first embodiment is described according to the present invention. The system power supply apparatus includes the first constant voltage circuit 2 serving as a series regulator, the second constant voltage circuit 3 serving as a series regulator and a control circuit 4 that controls operations of the first and second constant voltage circuits 2 and 3. The first constant voltage circuit 2 converts an input voltage Vbat into a prescribed constant voltage v1, and outputs it as an output voltage Vo1 to a load 10 through an output terminal OUT1. Similarly, the second constant voltage circuit 3 converts an input voltage Vbat into a prescribed constant voltage V2 or V3, and outputs it as an output voltage Vo2 to a load 11 through an output terminal OUT2. Condensers C1 and C2 are connected between the output terminal OUT1 and the ground, and the output terminal OUT2 and the ground, respectively.

The first constant voltage circuit 2 includes the first reference voltage generation circuit 21 that generates and outputs a prescribed reference voltage Vr1, a differential amplifier circuit A21, an output transistor M21 of a PMOS transistor, and a plurality of resistances R21 and R22 for output voltage detection use. Further, the second constant voltage circuit 3 includes the second reference voltage generation circuit 31 that generates and outputs a prescribed reference voltage Vr2, a differential amplifier circuit A31, an output transistor M31 of a PMOS transistor, a plurality of resistances R31 and R33 for output voltage detection use, and a switch SW.

An output transistor M21 is connected between the input voltage Vbat and the output terminal OUT1 in the first constant voltage circuit 2. A plurality of resistances (i.e., divider) R21 and R22 are serially connected between the output terminal OUT1 and the ground. A division voltage Vfb1 generated by dividing the output voltage Vo1 with the plurality of resistances R21 and R22 is input to a non-inversion input terminal of the differential amplifier circuit A21. The reference voltage Vr1 is inputted to an inversion input terminal thereof. The differential amplifier circuit A21 is connected to a gate of the output transistor M21 through the output terminal and controls an operation of the output transistor M21 so that the division voltage Vfb1 can be the same as the voltage Vr1. The differential amplifier circuit A21 receives an input of a sleep signal SLP1 from the control circuit 4, and stops and turns off the output transistor M21 when the sleep signal SLP1 indicates execution of the sleep operation, and operates it when the signal SLP1 instructs no execution of the sleep operation. Further, a condenser C1 and a load 10 are connected between the output terminal OUT1 and the ground.

An output transistor M31 is connected between the input voltage Vbat and the output terminal OUT2 in the second constant voltage circuit 3. A plurality of resistances R31, R32, and R33 are serially connected between the output terminal OUT2 and the ground. The resistance R33 is connected in parallel to the switch. A division voltage Vfb2 generated at a connection between the resistances R31 and R32 is input to a non-inversion input terminal of the differential amplifier circuit A31. The reference voltage Vr2 is input to an inversion input terminal thereof. The differential amplifier circuit A31 is connected to a gate of the output transistor M31 through its output terminal and controls an operation of the output transistor M31 so that the division voltage Vfb2 can be the same as the voltage Vr2. The differential amplifier circuit A31 receives an input of a sleep signal SLP2 from the control circuit 4, and stops and turns off the output transistor M31 when the sleep signal SLP2 instructs execution of the sleep operation, and operates it when the signal SLP2 instructs no execution of the sleep operation. The control circuit 4 controls the switch with a switch control signal SWC. Further, a condenser C2 and a load 11 are connected between the output terminal OUT2 and the ground.

With such a configuration, an output voltage Vo2 of the second constant voltage circuit 3 changes in response to turning on and off of the switch SW. A setting voltage V2 of the output voltage Vo2 is calculated by the following first formula when the switch SW is turned on to be conductive, wherein r31 and r32 represent values of the resistances R31 and R32, respectively;

$$V2=Vr2\times(r31+r32)/r32 \quad (1).$$

A setting voltage V3 of the output voltage Vo2 is calculated by the following second formula when the switch SW is turned off to be a cutoff condition, wherein r33 represents a value of the resistance R33;

$$V3=Vr2\times(r31+r32+r33)/(r32+r33) \quad (2).$$

As understood from the first and second formulas, the setting voltage V3 becomes less than that of V2.

Each of FIGS. 2 to 5 illustrates exemplary rising conditions of output voltages Vo1 and Vo2 outputted from the first and second constant voltage circuits 2 and 3, wherein Δ (delta) V represents a voltage difference between the respective output voltages Vo1 and Vo2 (i.e., Vo1−Vo2), and t1 and t2 are times when the output voltages Vo1 and Vo2 reach the setting voltages V1 and V2, respectively.

Now, it is supposed here that the below described first and second rising conditions are met in the first and second constant voltage circuits 2 and 3, wherein Vc is a constant of a prescribed voltage less than a setting voltage V1;

$$t1<t2,$$

(Hereinafter referred to as a first condition) and $$\Delta(\text{delta})V<Vc$$

(Hereinafter referred to as a second condition).

Figure 2:
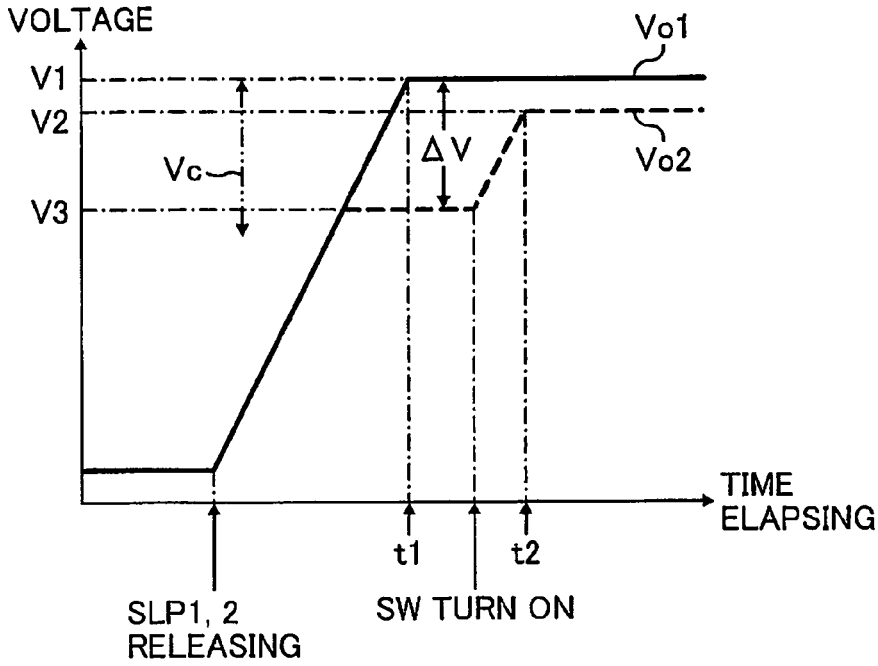
FIG. 2 illustrates exemplary rising conditions of output voltages Vo1 and Vo2 according to the present invention.

FIG. 2 illustrates an example when rise times of the output voltages Vo1 and Vo2 of the first and second constant voltage circuits 2 and 3 are substantially the same. As shown, the control circuit 4 initially turns off the switch SW upon receiving a switch control signal SWC. The control circuit 4 releases respective sleeping statuses of the first and second constant voltage circuits 2 and 3 using sleep signals SLP1 and SLP2. The output voltages Vo1 and Vo2 of the respective first and second constant voltage circuits 2 and 3 rise at substantially the same voltage, while the output voltage Vo2 rises and maintains a setting voltage V3. The control circuit 4 switches the switch SW from turning on to turning off using a switch control signal SWC when determining that the output voltage Vo1 reaches the setting voltage V1. Then, the output voltage Vo2 rises again and maintains a setting voltage V2. As understood from FIG. 2, by decreasing the difference between the setting voltages V1 and V3 to be less than the constant Vc (e.g. Vc>V1−V3), the above-mentioned conditions can be credibly met.

Figure 3:
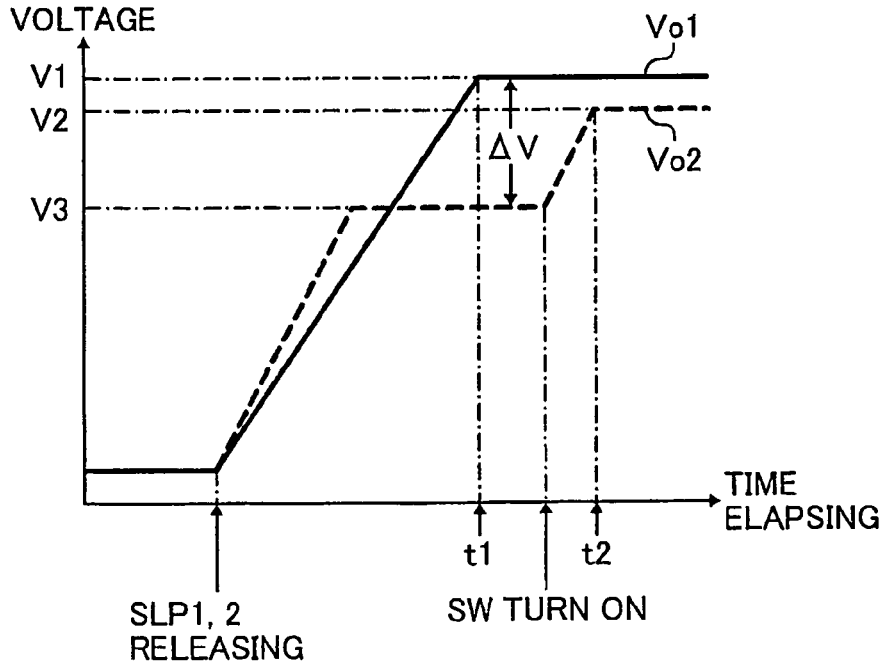
FIG. 3 illustrates the other exemplary rising conditions of output voltages Vo1 and Vo2 according to the present invention.
Figure 4:
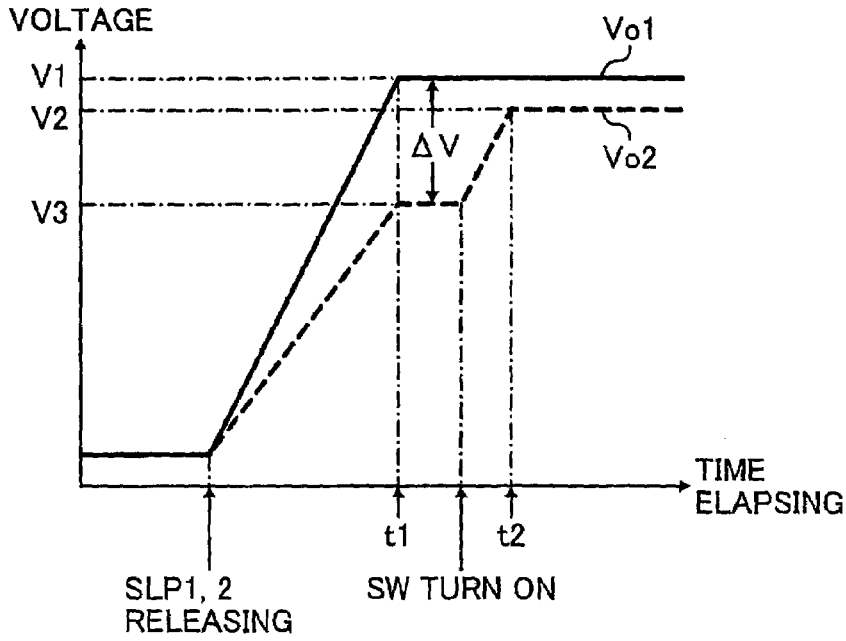
FIG. 4 illustrates still the other exemplary rising conditions of output voltages Vo1 and Vo2 according to the present invention.

FIG. 3 illustrates another example when the first constant voltage circuit 2 rises later than the second constant voltage circuit 3. The control circuit 4 also credibly meets the first and second conditions in this example by executing similar controlling as executed in FIG. 2. FIG. 4 illustrates a still another example when the second constant voltage circuit 3 rises slower than the first constant voltage circuit 2. When the control circuit 4 similarly executes controlling as executed in FIG. 2, the conditions are credibly met.

Figure 5:
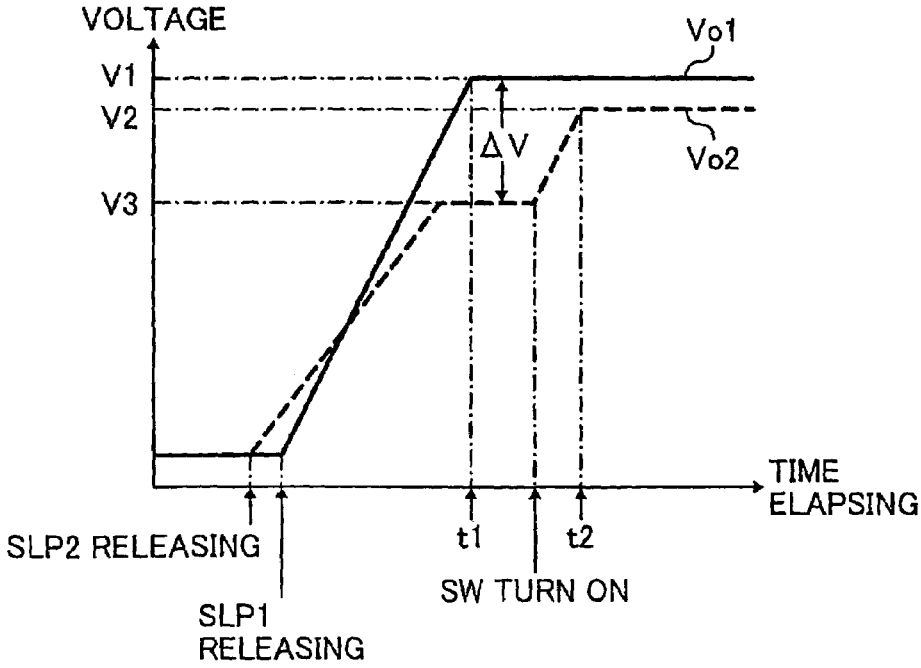
FIG. 5 illustrates still the other exemplary rising conditions of output voltages Vo1 and Vo2 according to the present invention.
Figure 6:
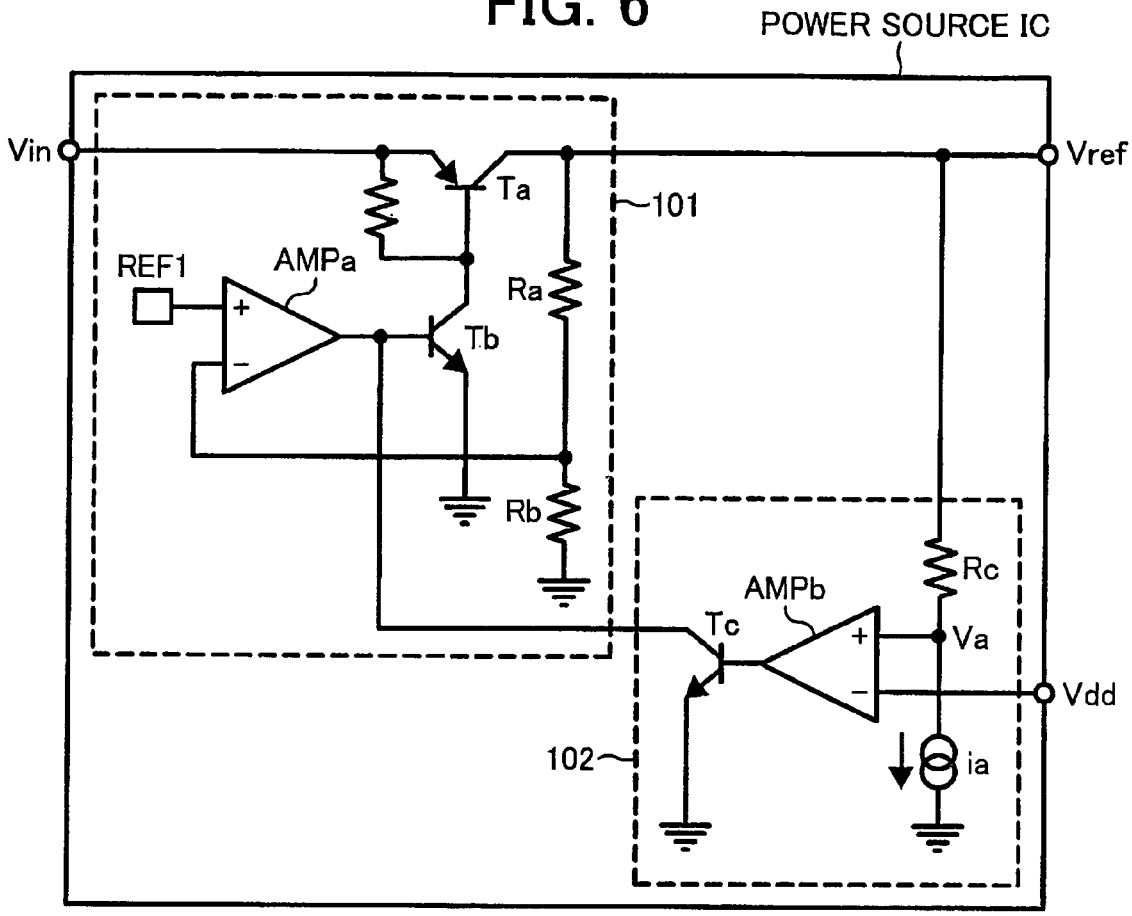
FIG. 6 illustrates a conventional power supply circuit.
Figure 7:
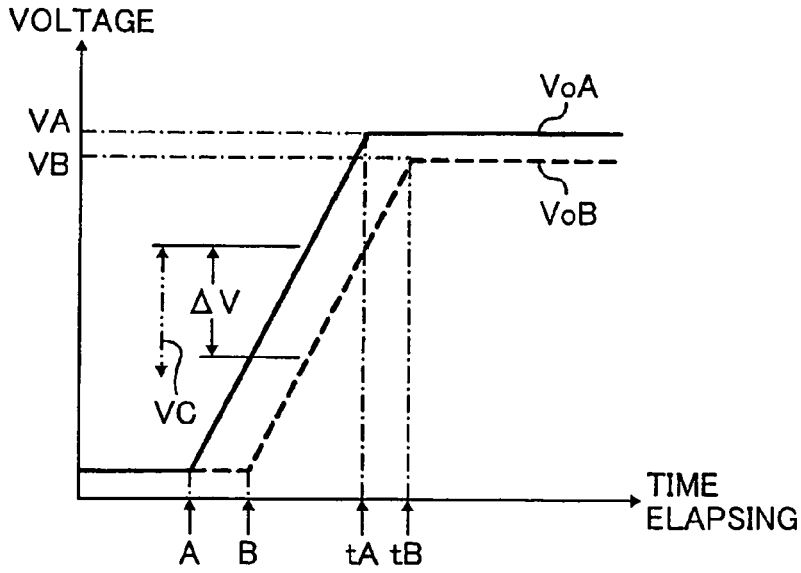
FIG. 7 illustrates conventional rising conditions of output voltages VoA and VoB of the first and second constant voltage circuits.
Figure 8:
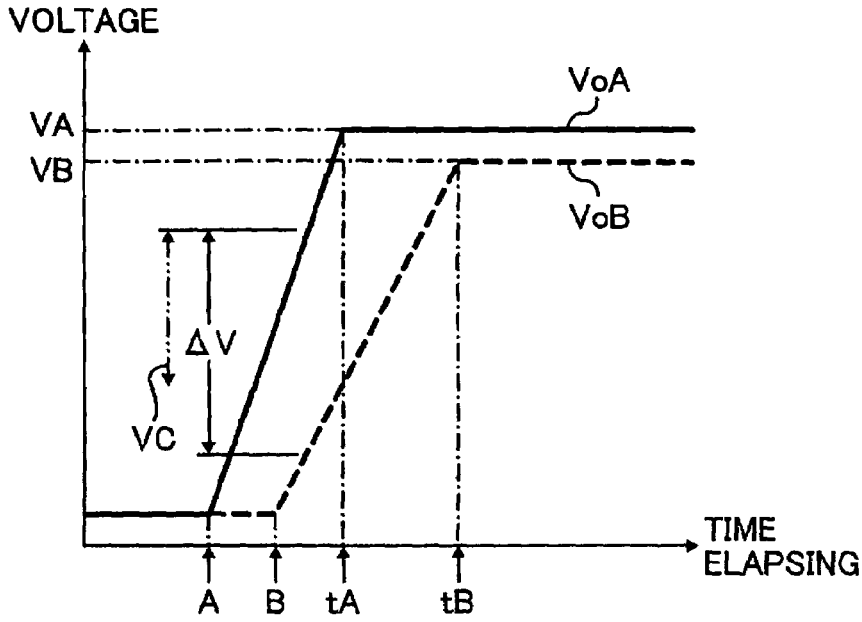
FIG. 8 illustrates the other conventional rising conditions of output voltages VoA and VoB of the first and second constant voltage circuits.
Figure 9:
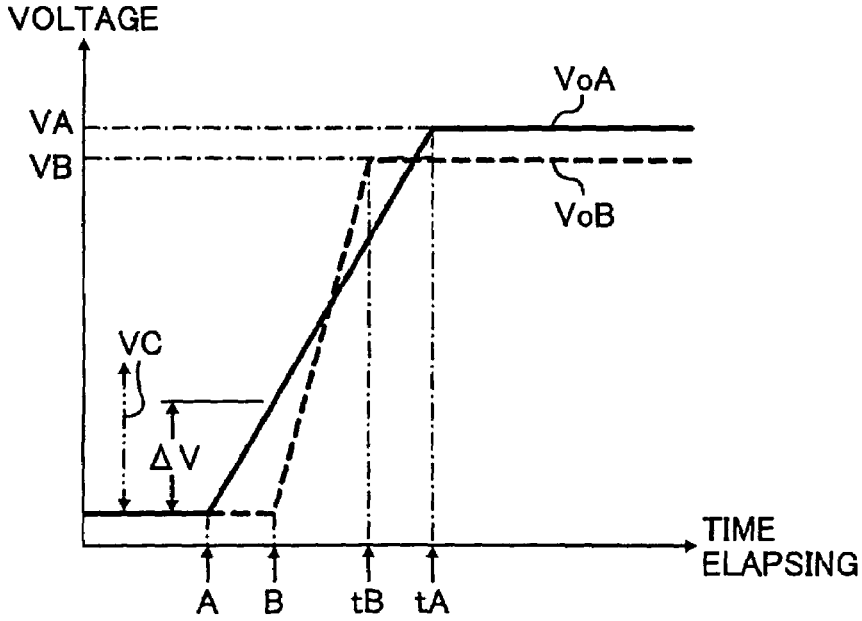
FIG. 9 illustrates still the other conventional rising conditions of output voltages VoA and VoB of the first and second constant voltage circuits.

However, when the second constant voltage circuit 3 rises extraordinary slow, delta V likely becomes larger than the constant Vc. Thus, when it is previously known that the second constant voltage circuit 3 rises later than the first constant voltage circuit 2, the second constant voltage circuit 3 is controlled to start operation slightly earlier than the first constant voltage circuit 2 as shown in FIG. 5. Specifically, by releasing the sleep status of the second constant voltage circuit 3 slightly earlier than that of the first constant voltage circuit 2, the above-mentioned first and second conditions can be credibly satisfied.

A manner of controlling the second constant voltage circuit 3 to start earlier than the first constant voltage circuit 2 can be applied to the examples of FIGS. 2 and 3. It is possible to check if the first constant voltage circuit 2 reaches a setting voltage V1 as a target voltage by measuring an output voltage Vo1 of the first constant voltage circuit 2.

However, according to one embodiment of the present invention, rise times of the first constant voltage circuit 2 have been investigated under various load conditions, and the maximum rise time was determined based on the investigation. Then, a voltage set to the second constant voltage circuit 3 is changed from V3 to V2, when the maximum time has been elapsed. Thus, the above-mentioned first and second conditions can be achieved without a special circuit.

In this way, according to the system power supply apparatus of the first embodiment, when the first and second constant voltage circuits 2 and 3, related to each other, are started up, and both times when respective output voltages reach the setting voltages and a difference between the respective output voltages during the time are ruled, an output voltage Vo2 of the second constant voltage circuit 3, which generally reaches the setting voltage V2 later is temporarily maintained at a setting voltage V3 smaller than the setting voltage V2. Then, the setting voltage V3 is changed to that of V2 when an output voltage Vo1 of the first constant voltage circuit 2 reaches the setting voltage V1.

As a result, an order of reaching a target voltage in each of two constant voltage circuits, and a difference between the respective output voltages during rising can be assured.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A system power supply apparatus, comprising:

a first constant voltage circuit configured to generate and increase a voltage up to a first constant level when receiving a first control signal;

a first load connected to the first constant voltage circuit;

a second constant voltage circuit configured to generate and increase a voltage up to a second constant level upon receiving a second control signal, said second constant voltage circuit generating and maintaining a voltage at a third constant level lower than the second constant level for a prescribed time period upon receiving a third control signal;

a second load connected to the second constant voltage circuit; and a control circuit configured to provide the third control signal to the second constant voltage circuit when the system power supply apparatus starts up, said control circuit configured to provide the first control signal to said first constant voltage circuit, said control circuit configured to provide the second control signal to said second constant voltage circuit.

2. The system power supply apparatus, as claimed in claim 1, wherein said control circuit controls the first and second constant voltage circuits to simultaneously operate when the system power supply apparatus starts up, wherein said control circuit controls the second constant voltage circuit to generate and maintain the voltage at the third constant level until the voltage generated by the first constant voltage circuit reaches the first constant level, and wherein said control circuit controls the second constant voltage circuit to generate and increase the voltage up to the second constant level when the output voltage of the first constant voltage circuit reaches the first constant level.

3. The system power supply apparatus according to claim 1, wherein said control circuit controls the second constant voltage circuit to operate earlier than the first constant voltage circuit, wherein said control circuit controls the second constant voltage circuit to generate and maintain the voltage at the third constant level until the output voltage of the first constant voltage circuit reaches the first constant level, and wherein said control circuit controls the second constant voltage circuit to generate and increase the voltage up to the second constant level when the output voltage of the first constant voltage circuit reaches the first constant level.

4. The system power supply apparatus according to claim 2, wherein the control circuit controls the second constant voltage circuit to generate and increase the voltage up to the second constant level when a prescribed time needed for the output voltage of the first constant voltage circuit reaches the first constant level has elapsed.

5. A method of supply power to various loads, comprising the steps of:

generating a voltage up to a first constant level when receiving a first control signal;

outputting the first constant level voltage to a first load;

generating another voltage up to a second constant level upon receiving a second control signal;

outputting the second constant level voltage to a second load; and generating and maintaining and outputting a voltage at a third constant level lower than the second constant level for a prescribed time period before said another voltage reaches the second level.

6. The system power supply apparatus according to claim 3, wherein the control circuit controls the second constant voltage circuit to generate and increase the voltage up to the second constant level when a prescribed time needed for the output voltage of the first constant voltage circuit reaches the first constant level has elapsed.

7. A system power supply apparatus, comprising:

a first constant voltage circuit configured to generate and increase a voltage up to a first constant level when receiving a first control signal, further configured to connect to a first load;

a second constant voltage circuit configured to generate and increase a voltage up to a second constant level upon receiving a second control signal, said second constant voltage circuit generating and maintaining a voltage at a third constant level lower than the second constant level for a prescribed time period upon receiving a third control signal, further configured to connect to a second load; and a control circuit configured to provide the third control signal to the second constant voltage circuit when the system power supply apparatus starts up, said control circuit configured to provide the first control signal to said first constant voltage circuit, said control circuit configured to provide the second control signal to said second constant voltage circuit.

8. The system power supply apparatus, as claimed in claim 7, wherein said control circuit controls the first and second constant voltage circuits to simultaneously operate when the system power supply apparatus starts up, wherein said control circuit controls the second constant voltage circuit to generate and maintain the voltage at the third constant level until the voltage generated by the first constant voltage circuit reaches the first constant level, and wherein said control circuit controls the second constant voltage circuit to generate and increase the voltage up to the second constant level when the output voltage of the first constant voltage circuit reaches the first constant level.

9. The system power supply apparatus according to claim 7, wherein said control circuit controls the second constant voltage circuit to operate earlier than the first constant voltage circuit, wherein said control circuit controls the second constant voltage circuit to generate and maintain the voltage at the third constant level until the output voltage of the first constant voltage circuit reaches the first constant level, and wherein said control circuit controls the second constant voltage circuit to generate and increase the voltage up to the second constant level when the output voltage of the first constant voltage circuit reaches the first constant level.

10. The system power supply apparatus according to claim 8, wherein the control circuit controls the second constant voltage circuit to generate and increase the voltage up to the second constant level when a prescribed time needed for the output voltage of the first constant voltage circuit reaches the first constant level has elapsed.

11. The system power supply apparatus according to claim 9, wherein the control circuit controls the second constant voltage circuit to generate and increase the voltage up to the second constant level when a prescribed time needed for the output voltage of the first constant voltage circuit reaches the first constant level has elapsed.

12. A system power supply apparatus, comprising:

a first constant voltage circuit configured to generate and increase a voltage up to a first constant level when receiving a first control signal, further configured to connect to a first load;

a second constant voltage circuit configured to generate and increase a voltage up to a second constant level upon receiving a second control signal, said second constant voltage circuit generating and maintaining a voltage at a third constant level lower than the second constant level for a period of time upon receiving a third control signal, further configured to connect to a second load; and a control circuit configured to provide the third control signal to the second constant voltage circuit when the system power supply apparatus starts up, said control circuit configured to provide the first control signal to said first constant voltage circuit, said control circuit configured to provide the second control signal to said second constant voltage circuit.

13. The system power supply apparatus of claim 12, wherein said second constant voltage circuit is configured to generate and maintain a voltage at a third constant level lower than the second constant level until said voltage generated by said first constant voltage circuit reaches said first constant level.

14. The system power supply apparatus of claim 12, wherein said second constant voltage circuit is configured to generate and maintain a voltage at a third constant level lower than the second constant level for a prescribed time period.

15. The method of claim 5, wherein the second control signal is received at substantially the same time as the first control signal.

16. The method of claim 5, wherein the second control signal is received prior to the first control signal.

* * * * *

UNITED STATES PATENT AND TRADEMARK OFFICE

CERTIFICATE OF CORRECTION

PATENT NO. : 7,622,901 B2
APPLICATION NO. : 11/477323
DATED : November 24, 2009
INVENTOR(S) : Ippei Noda It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 218 days.

Signed and Sealed this

Twenty-sixth Day of October, 2010

David J. Kappos

David J. Kappos
*Director of the United States Patent and Trademark Office*